US008961125B2

(12) United States Patent
Chuong et al.

(10) Patent No.: US 8,961,125 B2
(45) Date of Patent: Feb. 24, 2015

(54) GAS TURBINE ENGINE PART RETENTION

(75) Inventors: Conway Chuong, Manchester, CT (US); Kurt P. Werner, Tolland, CT (US); Shelton O. Duelm, Wethersfield, CT (US)

(73) Assignee: United Technologies Corporation, Hartford, CT (US)

( * ) Notice: Subject to any disclaimer, the term of this patent is extended or adjusted under 35 U.S.C. 154(b) by 604 days.

(21) Appl. No.: 13/324,110

(22) Filed: Dec. 13, 2011

(65) Prior Publication Data

US 2013/0149159 A1 Jun. 13, 2013

(51) Int. Cl.
*F01D 25/24* (2006.01)

(52) U.S. Cl.
USPC ..... 415/209.2

(58) Field of Classification Search
USPC ..... 415/209.2, 209.3, 213.1, 214.1, 185, 415/189, 193; 416/204 R, 219 R, 220 R; 29/889.22
See application file for complete search history.

(56) References Cited

U.S. PATENT DOCUMENTS

| | | | | |
|---|---|---|---|---|
| 2,397,815 | A * | 4/1946 | Smith | 415/209.1 |
| 2,915,281 | A * | 12/1959 | Ridley et al. | 415/209.2 |
| 3,429,351 | A * | 2/1969 | Szalanczy | 411/259 |
| 5,118,253 | A | 6/1992 | Balkcum, III | |
| 5,131,813 | A * | 7/1992 | Przytulski et al. | 416/217 |
| 5,201,846 | A * | 4/1993 | Sweeney | 415/173.6 |
| 5,513,547 | A * | 5/1996 | Lovelace | 81/484 |
| 6,095,750 | A | 8/2000 | Ross et al. | |
| 6,935,836 | B2 * | 8/2005 | Ress et al. | 415/173.2 |
| 7,125,222 | B2 | 10/2006 | Cormier et al. | |
| 7,238,003 | B2 | 7/2007 | Synnott et al. | |
| 7,445,427 | B2 | 11/2008 | Gutknecht et al. | |
| 7,618,234 | B2 | 11/2009 | Brackett et al. | |
| 7,651,319 | B2 | 1/2010 | Anderson et al. | |
| 7,819,622 | B2 | 10/2010 | Paulino et al. | |
| 2004/0005217 | A1 * | 1/2004 | Rainous et al. | 415/189 |
| 2004/0261265 | A1 | 12/2004 | Hagie et al. | |
| 2006/0153683 | A1 * | 7/2006 | Dube et al. | 416/220 R |
| 2008/0159860 | A1 * | 7/2008 | Cortequisse et al. | 415/214.1 |
| 2008/0286098 | A1 * | 11/2008 | Van Heusden et al. | 415/209.2 |
| 2009/0169376 | A1 * | 7/2009 | Morgan et al. | 415/209.2 |

FOREIGN PATENT DOCUMENTS

| | | | |
|---|---|---|---|
| EP | 1589194 | B1 | 7/2010 |
| FR | 2660362 | A1 | 10/1991 |

OTHER PUBLICATIONS

Extended European Search Report for European Application No. EP 12 19 6766 dated Sep. 24, 2013.

* cited by examiner

*Primary Examiner* — Edward Look
*Assistant Examiner* — Aaron R Eastman
(74) *Attorney, Agent, or Firm* — Carlson, Gaskey & Olds

(57) ABSTRACT

A gas turbine engine includes an engine casing structure and a retention block assembly. The engine casing structure includes a pocket which receives the retention block assembly. The retention block assembly includes a stop block and a pin that retains the stop block within the pocket. The stop block is loose relative to the pin.

19 Claims, 7 Drawing Sheets

GAS TURBINE ENGINE PART RETENTION

BACKGROUND

This disclosure relates to a gas turbine engine, and more particularly to retaining a part relative to an engine casing structure.

Gas turbine engines typically include at least a compressor section, a combustor section and a turbine section. During operation, air is pressurized in the compressor section and is mixed with fuel and burned in the combustor section to generate hot combustion gases. The hot combustion gases are communicated through the turbine section which extracts energy from the hot combustion gases to power the compressor section and other gas turbine engine loads.

One or more sections of the gas turbine engine can include a plurality of vane assemblies having vanes interspersed between rotor assemblies that carry the blades of successive stages of the section. Each vane of a vane assembly must be retained to an engine casing structure for proper functioning during gas turbine engine operation. Tabs, hooks and other features are typically incorporated into the design of the vanes to achieve this retention.

SUMMARY

A gas turbine engine includes an engine casing structure and a retention block assembly. The engine casing structure includes a pocket that receives the retention block assembly. The retention block assembly includes a stop block and a pin that retains the stop block in the pocket. The stop block is loose relative to the pin.

In another exemplary embodiment, a gas turbine engine includes a compressor section, a combustor section and a turbine section each disposed about an engine centerline axis. An engine casing structure is associated with at least a portion of the compressor section and the turbine section. At least one of the compressor section and the turbine section includes a part and a retention block assembly that circumferentially retains the part relative to the engine casing structure.

In yet another exemplary embodiment, a method of retaining a part to an engine casing structure includes providing a pocket in the engine casing structure, inserting a stop block into the pocket, and retaining the stop block in the pocket with a pin. The pin is trapped by a portion of the part.

The various features and advantages of this disclosure will become apparent to those skilled in the art from the following detailed description. The drawings that accompany the detailed description can be briefly described as follows.

DETAILED DESCRIPTION

Figure 1:
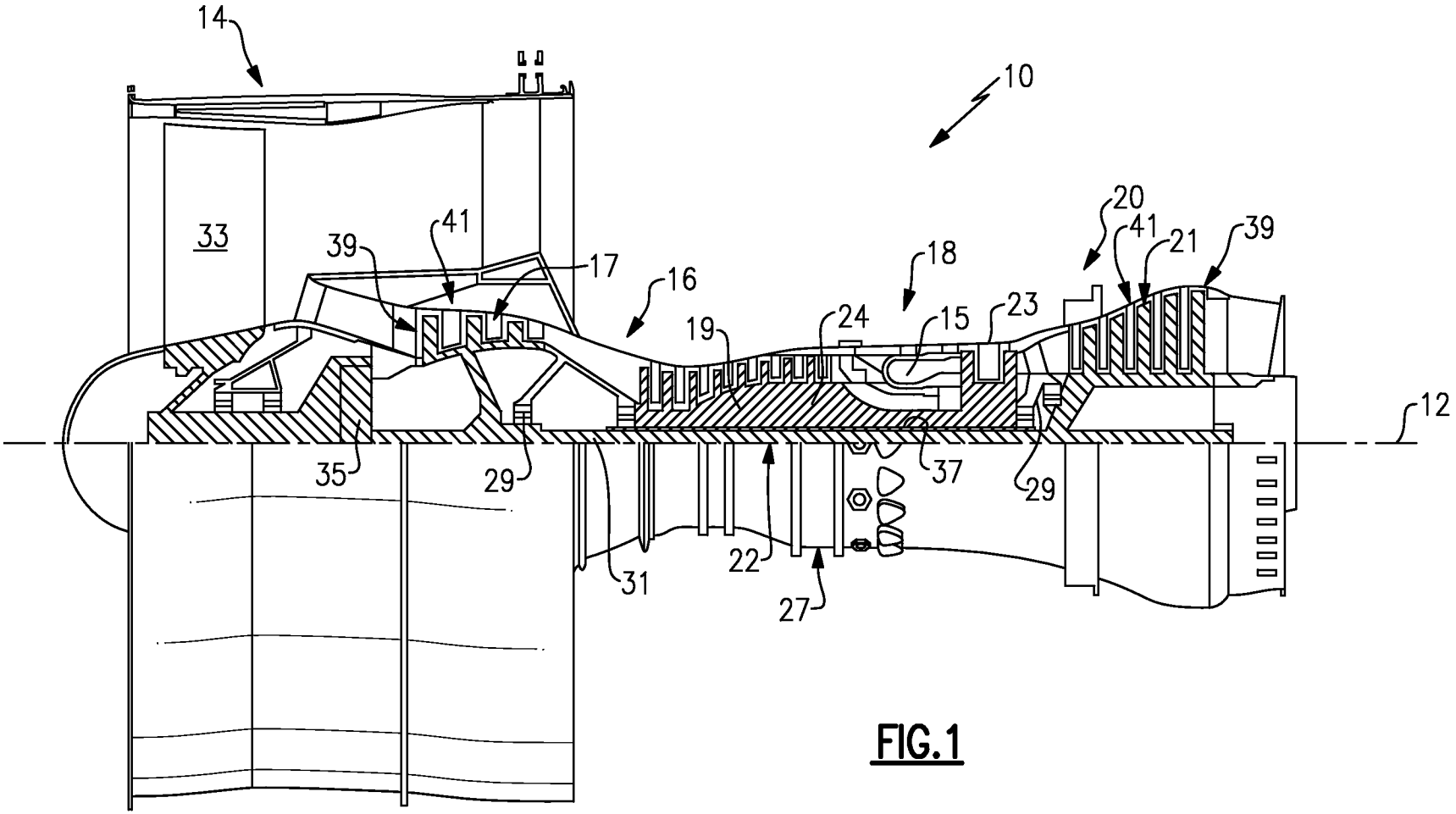
FIG. 1 schematically illustrates a gas turbine engine.

FIG. 1 schematically illustrates a gas turbine engine 10. The example gas turbine engine 10 is a two spool turbofan engine that generally incorporates a fan section 14, a compressor section 16, a combustor section 18 and a turbine section 20. Alternative engines might include fewer or additional sections such as an augmenter section (not shown), among other systems or features. Generally, the fan section 14 drives air along a bypass flow path, while the compressor section 16 drives air along a core flow path for compression and communication into the combustor section 18. The hot combustion gases generated in the combustor section 18 are expanded through the turbine section 20. This view is highly schematic and is included to provide a basic understanding of the gas turbine engine 10 and not to limit the disclosure. This disclosure extends to all types of gas turbine engines and to all types of applications, including but not limited to, three spool turbofan configurations.

The gas turbine engine 10 generally includes at least a low speed spool 22 and a high speed spool 24 mounted for rotation about an engine centerline axis 12 relative to an engine static structure 27 via several bearing systems 29. The low speed spool 22 generally includes an inner shaft 31 that interconnects a fan 33, a low pressure compressor 17, and a low pressure turbine 21. The inner shaft 31 can connect to the fan 33 through a geared architecture 35 to drive the fan 33 at a lower speed than the low speed spool 22. Although the geared architecture 35 is schematically depicted between the fan 33 and the low pressure compressor 17, it should be understood that the geared architecture 35 could be disposed at any location of the gas turbine engine, including but not limited to, adjacent the low pressure turbine 21. The high speed spool 24 includes an outer shaft 37 that interconnects a high pressure compressor 19 and a high pressure turbine 23.

A combustor 15 is arranged between the high pressure compressor 19 and the high pressure turbine 23. The inner shaft 31 and the outer shaft 37 are concentric and rotate about the engine centerline axis 12. A core airflow is compressed by the low pressure compressor 17 and the high pressure compressor 19, is mixed with fuel and burned within the combustor 15, and is then expanded over the high pressure turbine 23 and the low pressure turbine 21. The turbines 21, 23 rotationally drive the low speed spool 22 and the high speed spool 24 in response to the expansion.

The compressor section 16 and the turbine section 20 can each include alternating rows of rotor assemblies 39 and vane assemblies 41. The rotor assemblies 39 carry a plurality of rotating blades, while each vane assembly 41 includes a plurality of stator vanes. The blades of the rotor assemblies 39 create or extract energy (in the form of pressure) from the airflow that is communicated through the gas turbine engine 10. The vanes of the vane assemblies 41 direct airflow to the blades of the rotor assemblies 39 to either add or extract energy. Each vane of the vane assemblies 41 is circumferentially retained to the gas turbine engine 10, as is further discussed below.

Figure 2A:
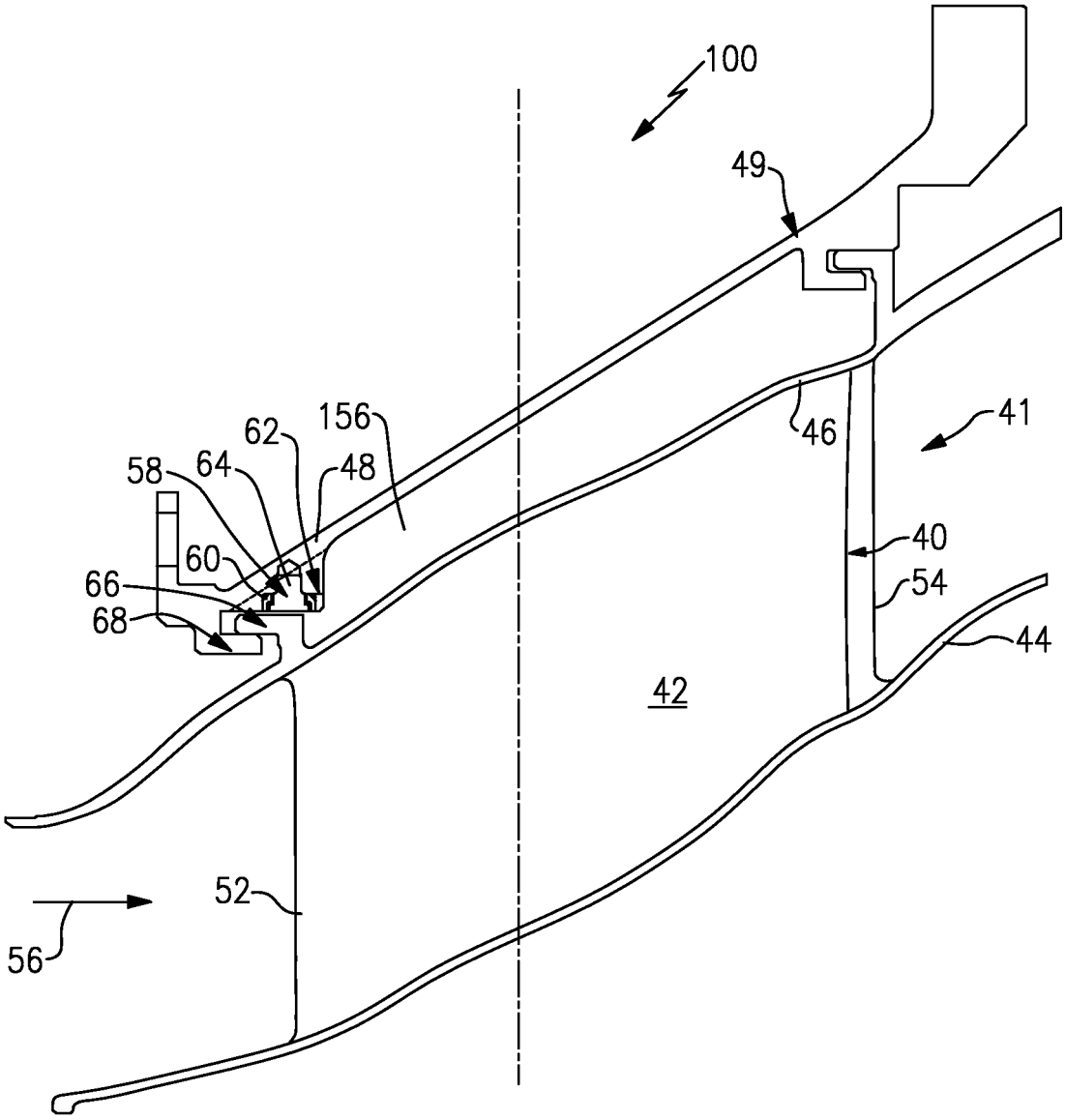
FIGS. 2A and 2B illustrate a portion of a gas turbine engine.
Figure 2B:
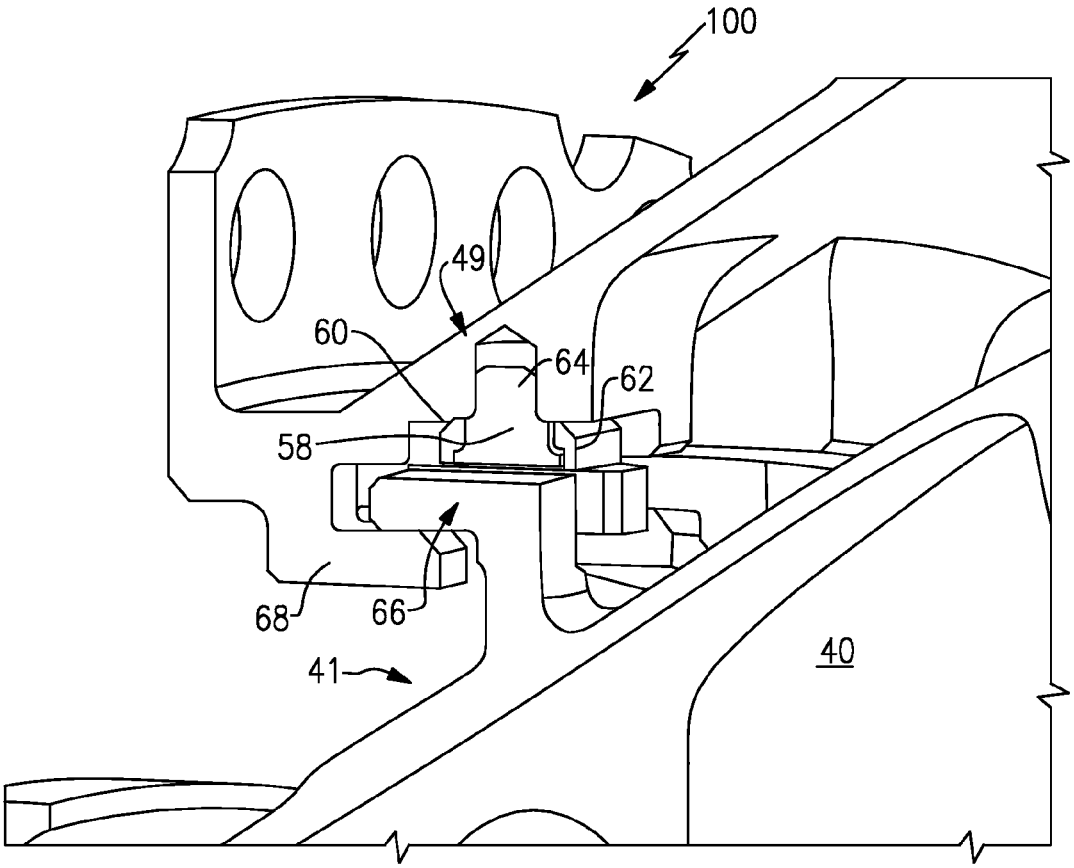

FIGS. 2A and 2B illustrate a portion 100 of a gas turbine engine 10. In this example, the illustrated portion 100 is of the turbine section 20. However, this disclosure is not limited to the turbine section 20, and could extend to other sections of the gas turbine engine 10, including but not limited to the compressor section 16.

The portion 100 includes a part, such as a vane assembly 41. The vane assembly 41 includes a plurality of vanes 40 (only one shown) that are circumferentially disposed (into and out of the page of FIG. 2A) about the engine centerline axis 12. Each vane 40 includes an airfoil 42 that extends between an inner platform 44 and an outer platform 46. The vane assembly 41 is connected to an engine casing structure 49 associated with the portion 100 of the gas turbine engine 10, such as between an outer casing structure 48 and an inner ring structure 50. The inner ring structure 50 could be a portion of a rotor assembly of an adjacent rotor assembly 39, or could be a separate structure all together.

The vane 40 can be a stationary vane or a variable vane and could be cantilevered. The vanes 40 of the vane assembly 41 extend between a leading edge 52 and a trailing edge 54. The gas turbine engine 10 establishes a gas path 56 (for the communication of core airflow) that extends in a direction from the leading edge 52 toward the trailing edge 54 of the vane 40.

The vane 40 is circumferentially retained within the gas turbine engine 10 by a retention block assembly 58. Although depicted as a vane, it should be understood that the retention block assembly 58 could be used to retain any part of the gas turbine engine. The retention block assembly 58 is received in a pocket 60 of the engine casing structure 49. As used in this disclosure, the term "engine casing structure" can refer to the outer casing structure 48, the inner ring structure 50, or any other portion of the engine static structure 27. In other words, the retention block assembly 58 can be implemented into the outer casing structure 48, the inner ring structure 50, or both to circumferentially retain the vane 40 of the vane assembly 41 within the portion 100 of the gas turbine engine 10. Each vane 40 of the vane assembly 41 can be circumferentially retained using one or more retention block assemblies 58. The pocket 60 can be machined, milled, cast or otherwise formed into the engine casing structure 49 in any known manner.

The retention block assembly 58 includes a stop block 62 and a pin 64 that retains the stop block 62 within the pocket 60. A vane hook 66 is axially received by a case hook 68 of the engine casing structure 49. The vane hook 66 is positioned radially inboard of the retention block assembly 58 in an installed state. The vane hook 66 traps the pin 64 relative to the stop block 62. In one example, the pin 64 is radially trapped relative to the stop block 62 via the vane hook 66.

During engine operation, the circumferential pressure loads of the vane 40 are transferred to the retention block assembly 58, which are then transferred to the engine casing structure 49. In other words, the pin 64 is substantially free from mechanical loading during engine operation. The inner platform 44 and the outer platform 46 of the vane 40 can include various other retention features such as vane hooks, tabs, legs, flanges and other parts to achieve radial and axial attachment of the vane 40 relative to the engine casing structure 49. These features can work independently of the exemplary circumferential retention feature, or can work in concert with it and provide combined degrees of constraint.

Figure 3:
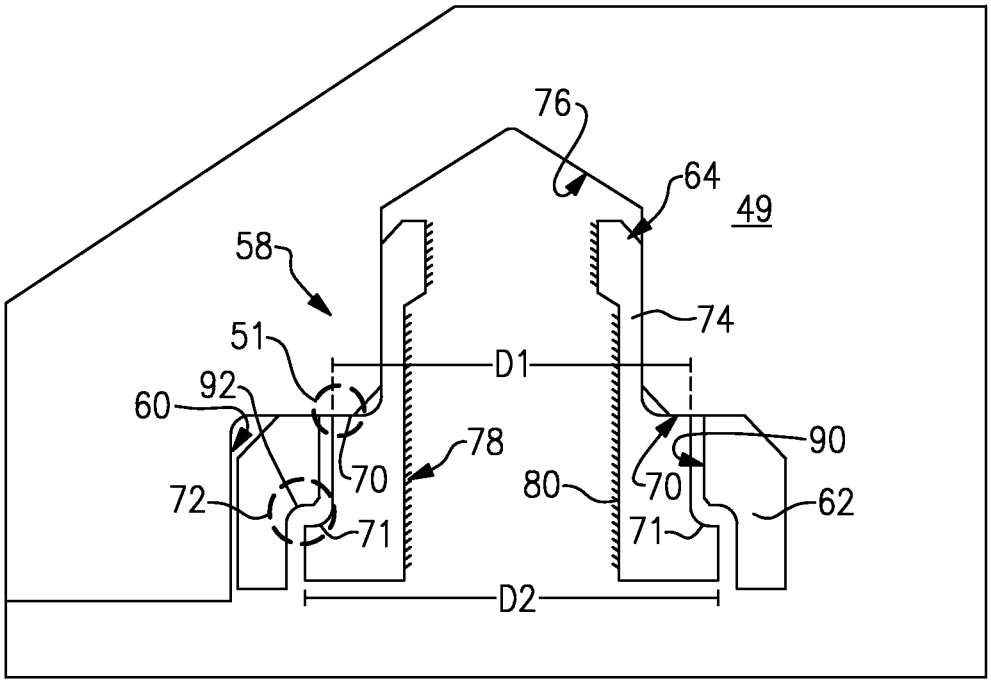
FIG. 3 illustrates an example retention block assembly for retaining a vane of a vane assembly.

FIG. 3 illustrates a cross-sectional view of the retention block assembly 58 introduced in FIGS. 2A and 2B. The stop block 62 is received within the pocket 60 of the engine casing structure 49. Alternatively, the stop block 62 could be incorporated as part of the engine casing structure 49. In other words, the stop block 62 could be a separate structure from the engine casing structure 49 or could be integrally formed as part of the engine casing structure 49.

The pin 64 retains the stop block 62 within the pocket 60. The pin 64 is inserted through a bore 90 of the stop block 62 and can be press-fit into an opening 76 of the engine casing structure 49. A body portion 74 of the pin 64 extends into the opening 76 of the engine casing structure 49. The bore 90 is oversized relative to the pin 64 (i.e., the bore 90 is a greater diameter than the pin 64 diameter). The bore 90 is oversized to create a gap 72 and enable relative freedom of the stop block 62 to the pin 64 and the pocket 60. Other than the press fit pin 64, the retention block assembly 58 is otherwise free of mechanical attachments including screws or bolts for circumferentially retaining the vanes 40 of the vane assembly 41. The vane hook 66 provides a secondary retention feature that prevents the pin 64 from liberating from the retention block assembly 58 (See FIG. 2B).

A first flange 70 that extends from the body portion 74 of the pin 64 abuts (i.e., bottoms out against) the engine casing structure 49 at an interface 51. The gap 72 extends between the stop block 62 and the pin 64 such that the stop block 62 is loose relative to the pin 64 (as well as the engine casing structure 49). The gap 72 allows the stop block 62 to move in a radial and circumferential direction relative to the pin 64 during gas turbine engine operation thus allowing the pin 64 to be substantially free from mechanical loading during operation. The actual dimensions of the gap 72 can vary and are dependent on application and manufacturing tolerances, among other factors.

The pin 64 includes a second flange 71 that is received by a counterbore portion 92 of the stop block 62. The second flange 71 is radially inward from the first flange 70. The second flange 71 establishes a second diameter D2 that is larger than a first diameter D1 of the first flange 70, which retains the stop block 62 from liberating in the radial direction.

The pin 64 can also include an inner portion 78 that is bored through pin. The inner portion 78 can optionally include threads 80 that permit easy removal of the pin 64 from the retention block assembly 58.

Figure 4A:
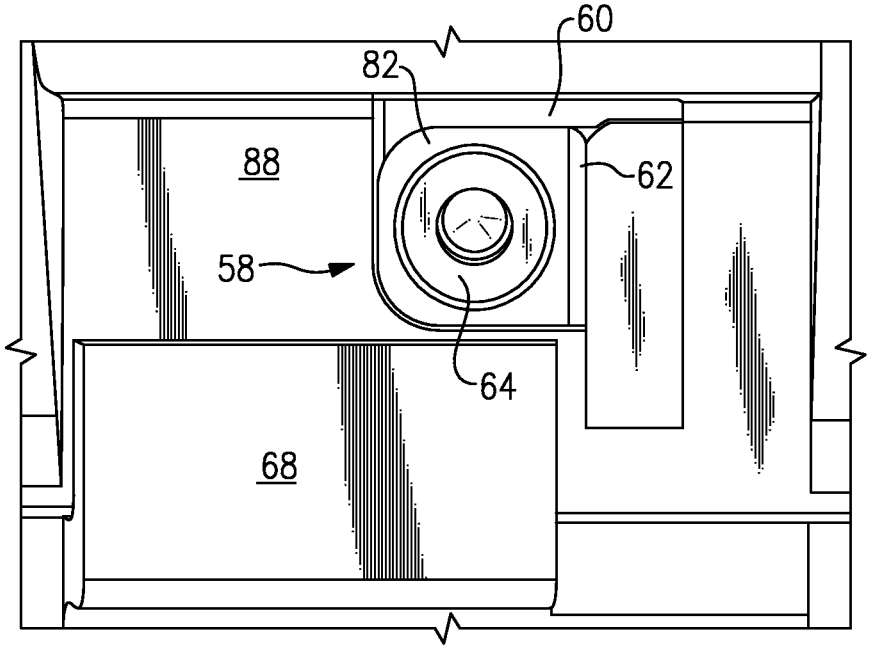
FIGS. 4A and 4B illustrate additional features of the retention block assembly of FIG. 3.
Figure 4B:
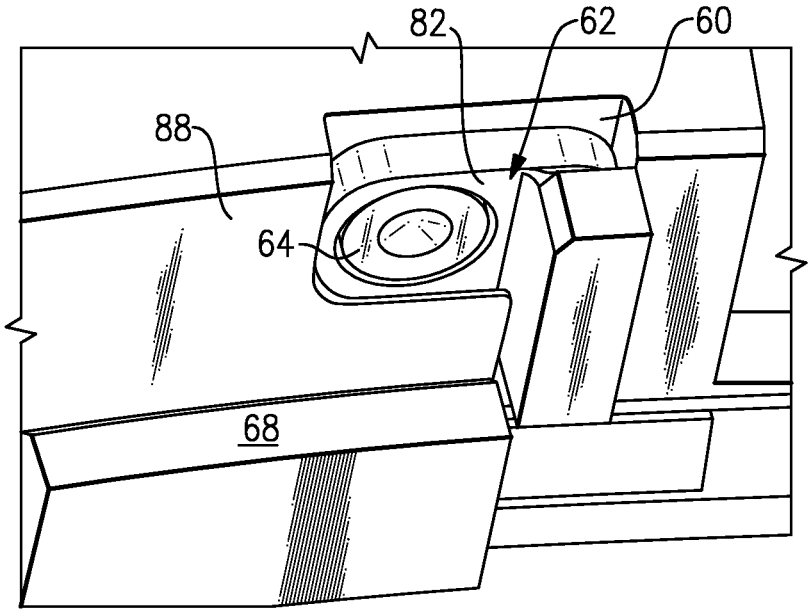

FIGS. 4A and 4B illustrate the retention block assembly 58 with the vane 40 removed to better illustrate the features of the retention block assembly 58. Both the pocket 60 and the stop block 62 can include a generally rectangular shape. The matched geometries of the pocket 60 and the stop block 62 substantially prevent the rotation of the stop block 62 within the pocket 60 during engine operation. The pocket 60 and the stop block 62 can include other geometries and configurations. The pin 64 is flush with or below a surface 82 of the stop block 62 in the installed state illustrated by FIGS. 4A and 4B. The surface 82 faces the vane 40 when the vane 40 is in an installed state.

In one example, the engine casing structure 49, the stop block 62 and the pin 64 are each manufactured from the same type of material to reduce any thermal mismatch between the parts during engine operation. Use of the same material aids in establishing the gap 72. One example material is a nickel alloy. However, other materials are also contemplated as within the scope of this disclosure.

Figure 5B:
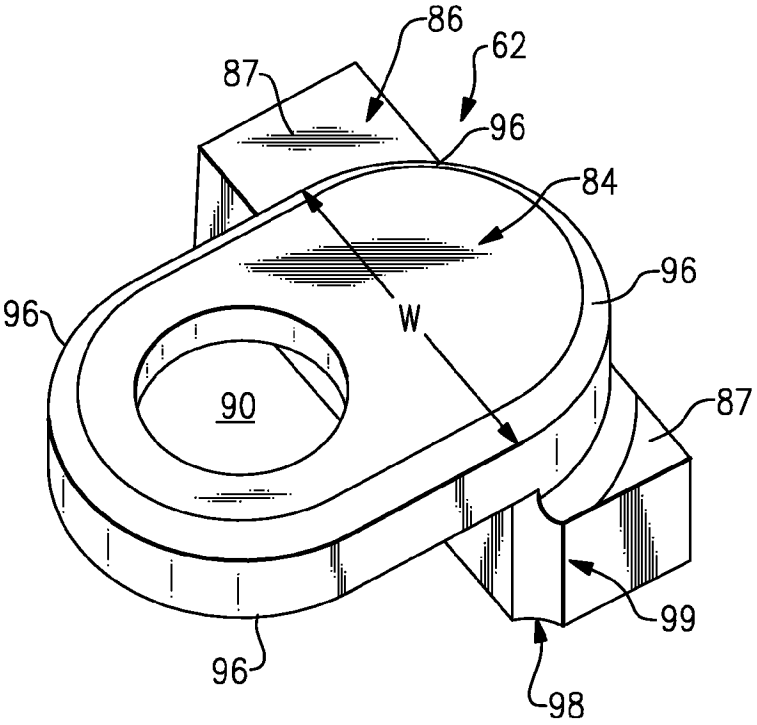
FIGS. 5A and 5B illustrate a stop block of a retention block assembly.
Figure 5A:
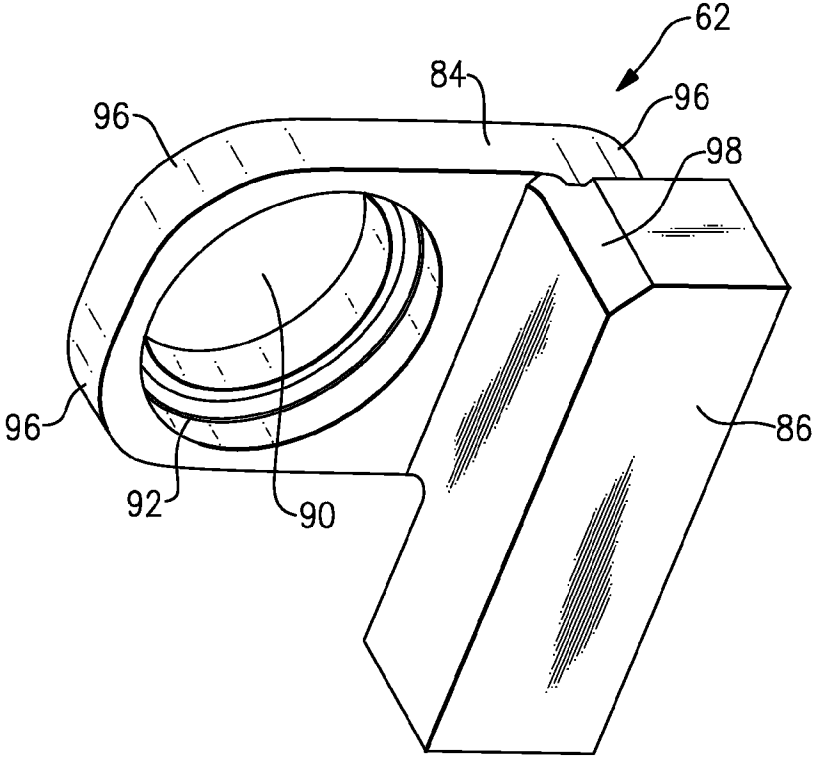

FIGS. 5A and 5B illustrate an example stop block 62 of the retention block assembly 58 detailed above. The stop block 62 includes a first block portion 84 and a second block portion 86 that protrudes from the first block portion 84. In one example, the second block portion 86 perpendicularly protrudes from the first block portion 84. The stop block 62 can include a monolithic structure or could be assembled by attaching the second block portion 86 to the first block portion 84 in any known manner.

The first block portion 84 is received within the pocket 60 and is flush with or below an outer surface 88 of the pocket 60 (see FIGS. 4A and 4B). The pocket 60 is closely toleranced to the first block portion 84 to minimize loose fit between the first block portion 84 and the pocket 60. The size, shape and geometry of the pocket 60 and the stop block 62 could vary depending upon design specific parameters and other design criteria.

The first block portion 84 includes a bore 90 that extends through the first block portion 84. The bore 90 includes a counterbore portion 92. The second flange 71 of the pin 64 is received within the counterbore portion 92 of the first block portion 84 (see FIG. 3). The first block portion 84 can also include rounded corners 96.

Figure 6:
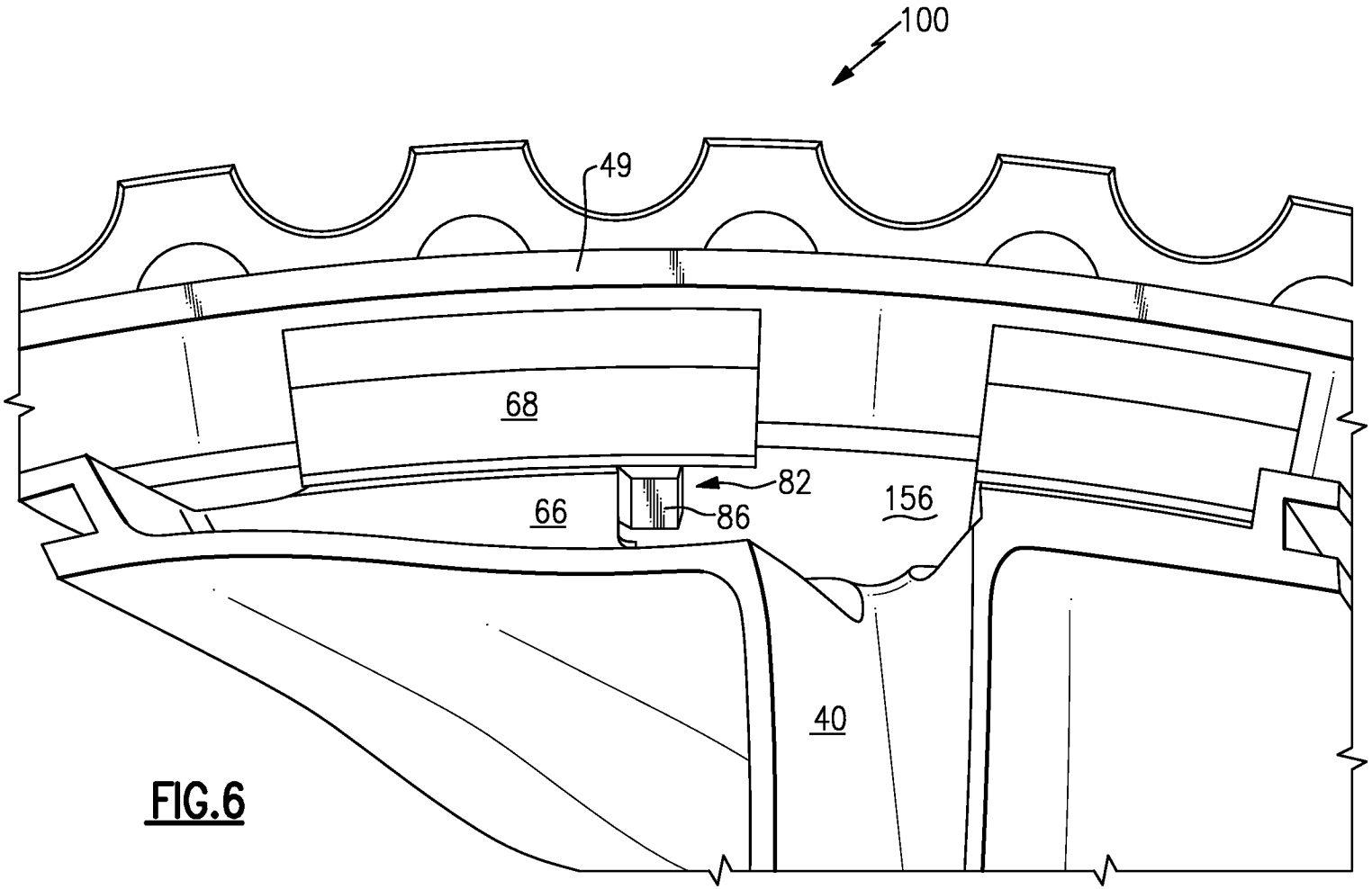
FIG. 6 illustrates an aft section view (looking forward) of a vane assembly of a gas turbine engine.

The second block portion 86 protrudes from the first block portion 84 in a direction toward the vane 40 (See FIGS. 4A, 4B and FIG. 6). The second block portion 86 can include portions 87 that axially extend beyond a width W of the first block portion 84. The second block portion 86 can also include at least one chamfered portion 98 that aids in the insertion of the vane 40 relative to the retention block assembly 58 to circumferentially retain the vane 40 relative to the engine casing structure 49. In this example, the chamfered portion 98 is defined at a corner 99 of the second block portion 86.

Referring to FIG. 6, a portion of the vane 40 contacts the second block portion 86 of the stop block 62 to prevent circumferential rotation of the vane 40. In one example, the portion is a vane hook 66, although other parts and components are contemplated. The second block portion 86 extends into a secondary air cavity 156 that is radially outboard of the gas path 56, while the first block portion 84 is radially outboard of the secondary air cavity 156 (See also FIG. 2A).

Although the different examples have the specific components shown in the illustrations, embodiments of this disclosure are not limited to those particular combinations. It is possible to use some of the components or features from one of the examples in combination with features or components from another one of the examples.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A gas turbine engine, comprising:

an engine casing structure that includes a pocket;

a retention block assembly received in said pocket; and a vane circumferentially retained relative to said engine casing structure by said retention block assembly; wherein said retention block assembly includes a stop block that contacts a portion of said vane to block circumferential rotation of said vane and a pin that retains said stop block in said pocket, and wherein said stop block is loose relative to said pin and said pin is inserted through a bore of said stop block and connected to said engine casing structure, wherein said pin includes an inner portion that is threaded.

2. The gas turbine engine as recited in claim 1, wherein a first flange of said pin abuts said engine casing structure.

3. The gas turbine engine as recited in claim 2, wherein a second flange of said pin is received within a counterbore portion of a bore of said stop block.

4. The gas turbine engine as recited in claim 1, wherein said stop block includes a first block portion and a second block portion that protrudes from said first block portion.

5. The gas turbine engine as recited in claim 4, wherein said second block portion includes a chamfered portion.

6. The gas turbine engine as recited in claim 4, wherein a portion of a vane contacts said second block portion.

7. The gas turbine engine as recited in claim 1, wherein said pin is radially trapped relative to said stop block with a vane hook.

8. The gas turbine engine as recited in claim 7, wherein said vane hook is axially received by a case hook of said engine casing structure.

9. The gas turbine engine as recited in claim 1, wherein a gap extends between said pin and said stop block.

10. The gas turbine engine as recited in claim 1, wherein said stop block is an integral part of said engine casing structure.

11. The gas turbine engine as recited in claim 1, wherein said pin includes a first flange having a first diameter and a second flange having a second diameter that is greater than said first diameter.

12. A gas turbine engine, comprising:

a compressor section, a combustor section and a turbine section each disposed about an engine centerline axis;

an engine casing structure associated with at least a portion of said compressor section and said turbine section; and wherein at least one of said compressor section and said turbine section includes at least one part and a retention block assembly that circumferentially retains said at least one part relative to said engine casing structure, wherein said retention block assembly includes a stop block and a pin that retains said stop block within a pocket of said engine casing structure in a manner in which said stop block is loose relative to said pin, said pin inserted through a bore of said stop block and connected to said engine casing structure, wherein said pin includes an inner portion that is threaded.

13. The gas turbine engine as recited in claim 12, comprising a gap that extends between said pin and said stop block such that said stop block is loose relative to said pin.

14. The gas turbine engine as recited in claim 12, wherein said at least one part is a vane.

15. The gas turbine engine as recited in claim 14, wherein said vane includes a vane hook that radially traps said pin within said pocket.

16. A method of retaining a part to an engine casing structure, comprising the steps of:

providing a pocket in an engine casing structure;

inserting a stop block into the pocket;

retaining the stop block in the pocket with a pin; and radially trapping the pin within the pocket relative to the stop block with a portion of the part, wherein the pin includes an inner portion that is threaded.

17. The method as recited in claim 16, comprising the step of:

providing a gap between the stop block and the pin such that the stop block is loose relative to the pin.

18. The method as recited in claim 16, wherein the step of retaining includes retaining the stop block within the pocket without using any other mechanical attachments except for the pin.

19. The method as recited in claim 16, wherein the step of trapping includes radially trapping the pin within the pocket with a vane hook.

* * * * *